United States Patent [19]

Lotspeich

[11] 4,196,951

[45] Apr. 8, 1980

[54] VENDOR WITH DOOR AND SHELF INTERLOCK

[75] Inventor: Joseph A. Lotspeich, South Saint Paul, Minn.

[73] Assignee: Gross-Given Manufacturing Company, Saint Paul, Minn.

[21] Appl. No.: 888,138

[22] Filed: Mar. 20, 1978

[51] Int. Cl.[2] ..... E05B 65/46; A47F 01/00; G07F 11/00

[52] U.S. Cl. ..... 312/218; 221/75; 312/220

[58] Field of Search ..... 221/281, 75; 312/220, 312/218, 215; 49/142, 143, 145; 312/311, 273, 274

[56] References Cited

U.S. PATENT DOCUMENTS

| | | | |
|---|---|---|---|
| 1,006,605 | 10/1911 | Tilton | 312/220 X |
| 2,095,811 | 10/1937 | Goulooze | 312/274 |
| 2,575,300 | 11/1951 | Schrager | 312/35 |
| 3,344,953 | 10/1967 | Krakauer et al. | 221/75 |
| 3,466,108 | 9/1969 | Guth | 312/311 X |
| 3,575,480 | 4/1971 | Peisker | 312/218 |
| 3,653,540 | 4/1972 | Offutt | 221/75 |
| 3,752,546 | 8/1973 | O'Neal | 312/35 |
| 3,870,387 | 3/1975 | Mortashed | 312/218 |
| 3,940,016 | 2/1976 | Krakauer | 221/129 |
| 4,046,440 | 9/1977 | Cox et al. | 312/218 X |

*Primary Examiner*—Robert J. Spar
*Assistant Examiner*—Edward M. Wacyra
*Attorney, Agent, or Firm*—Merchant, Gould, Smith, Edell, Welter & Schmidt

[57] ABSTRACT

A door and shelf interlock system for a vending machine comprises a vertically movable locking bar operatively coupled to the pivot structure of the door of the vending machine. The locking bar in a first position prevents any of the shelves from being pulled out from their normally retracted position inside the machine. A locking member is associated with each shelf. If the shelf is pulled out from its normally retracted position, the locking member engages the locking bar to prevent the door from being closed until the shelf is placed back into its retracted position.

13 Claims, 8 Drawing Figures

18
40
2
24
88
90
42
12
16
14
88
90
100
94
112
114
96
32
96
102
101
100

111
98
106
106
108
110
104
88
94
92
86
4
8
5
50
84
74
80
82
8
7
78
6
58
66
10
62
64
60
58
56
54
74
76
75

67
77
52
68
77
66
72
70
69
64
62

VENDOR WITH DOOR AND SHELF INTERLOCK

BACKGROUND OF THE INVENTION

1. Field of the Invention

This invention relates in general to automated food vending machines of the type having a plurality of dispensing trays or shelves which may be moved outwardly from the machine housing to facilitate loading the shelves with the various food products to be dispensed. More particularly, this invention relates to an interlock system between the door of the vending machine and the shelves. This interlock system prevents the shelves from being pulled outwardly until the door is fully open and also prevents the door from being closed when any of the shelves are pulled out of the housing.

2. Description of the Prior Art

Automated vending machines are well known for dispensing food products upon insertion by a purchaser of a required amount of money. Such vending machines have various kinds of dispensing mechanisms depending upon the particular types of food products which are being vended. One well known class of such vending machines is that known in the trade as helical coil vending machines or, alternatively, as spiral vendors. U.S. Pat. No. 4,061,245, issued on Dec. 6, 1977 to Joseph A. Lotspeich and assigned to the assignee of the present invention, is a typical example of such a helical coil vending machine. Such machines are widely used for dispensing pre-packaged food products including rolled candy, mints and the like, and for dispensing so called "snack" products, such as packages containing potato chips, pastries and the like.

Most helical coil dispensing machines customarily include a housing which supports a plurality of vertically spaced shelves. Each of the shelves usually includes a plurality of elongated dispensing coils which run from front to back on the shelf. The rear end of each dispensing coil is operatively connected to an electric motor for selectively rotating the coil. Such rotation advances the food products received between the convolutions of the coil in a step by step manner along the surface of the shelf. Upon each consecutive rotation of the coil, the product held in the foremost convolution is dispensed over the end of the shelf into a discharge space. The product carrying shelves in most of the vending machines of this type may be slid out of the machine when a door is opened to allow a serviceman to easily fill the coils with the food products to be dispensed. If the shelves could not be pulled out of the machine, the task of loading the coils would be difficult due to the lack of clearance space between adjacent shelves and the consequent difficulty in reaching the rearmost convolutions of the coil.

Vending machines which utilize movable shelves are sometimes damaged by careless or inexperienced servicemen. For example, servicemen sometimes fail to properly return all of the shelves in the vending machine to their fully retracted position inside the vending machine housing before attempting to close the door of the machine. Thus, the door will strike any of the shelves which are protruding outwardly from the machine as the serviceman attempts to close it. This contact often damages either the shelf and the dispensing coils contained thereon or, in some instances, the door. This requires that the vending machine be repaired. The need for such repair is disadvantageous and costly. In addition, the same damage can also occur when the serviceman attempts to pull a shelf out of the housing before the door is fully open.

Various devices have been proposed to prevent any shelves from being pulled out until the vending machine door is fully open and, thereafter, to prevent the door from closing when all of the shelves have not been returned to their fully retracted position. U.S. Pat. No. 4,046,440 discloses a device of this type. In this device, a locking bar is operatively connected to the pivot structure of the vending machine door. The locking bar activates a plurality of swingable latches which may be engaged with a locking lug on each of the shelves. Each of the shelves also includes a horizontally extending abutment on the side thereof. If each of the shelves is not in a fully retracted position when the operator attempts to close the door, the latches on the locking bar will engage the abutment. This prevents the locking bar from being moved to a position at which it will allow the door to be closed. The door can be closed only when all the latches do not engage any portion of the abutments on the dispensing shelves. In addition, none of the shelves can be pulled out of the machine until the locking bar drops down to clear all the latches with the locking lugs on the shelves. The downward movement of the locking bar occurs only when the door is fully open.

A disadvantage with the device noted above is the coaction which is required between the abutments and the latches. In other words, the above-noted device requires the presence of something on a shelf (i.e., the abutment) to prevent the door member from being closed. It is possible that not all vending machine shelves will be provided with such abutments or, if they are so provided, the abutments might not be of uniform length in different machines. Such machines would have to be modified to accept the above-noted device. In addition, the abutment provided on the shelves does not usually run the full length of the shelf. Thus, in certain cases, the door can be closed even when the shelves are extending outside of the housing where the shelf is pulled out sufficiently far such that the abutment has cleared the latch (e.g., the latch is in front or back of the abutment).

SUMMARY OF THE PRESENT INVENTION

It is an aspect of the present invention to provide a door and shelf interlock system for a vending machine which requires the absence of an element on the shelf, rather than the presence of an abutment, to actuate a locking mechanism for the shelf and the door.

The door and shelf interlock system of the present invention is usable in a vending machine of the type having a housing closed on one side by a pivotable door. The housing usually contains a plurality of slidable shelves which may be moved between a retracted dispensing position inside the housing and an extended loading position at least partially outside the housing. Each of the shelves further contains some type of dispensing means (e.g., at least one helical coil) for dispensing any food products contained on the shelf.

The door and shelf interlock system of this invention comprises a locking bar which is operatively connected to the door. The locking bar includes a plurality of spaced latches which respectively interfere with a stop on each of the shelves to normally prevent the shelves from being pulled out. When the door is fully open, the locking bar is actuated such that the latches clear all of the stops on the shelves to allow the shelves to be slid out of the housing to load food products thereon. The interlock system of this invention also includes a plurality of locking members each of which is positioned adjacent one of the shelves. When all of the shelves are in their retracted positions inside the housing, the locking members are normally held by each shelf in a position at which a locking surface on each of the locking members does not engage the locking bar. However, if any one of the shelves is pulled outwardly to an extended loading position, the locking surface on the corresponding locking member engages a recess on the locking bar to prevent the locking bar from being moved upwardly. This locks the door in a fully open position and prevents it from being closed when any of the shelves are in an extended loading position.

BRIEF DESCRIPTION OF THE DRAWINGS

This invention will be described hereafter in the Detailed Description, when taken in conjunction with the following figures, in which like reference numerals will refer to like elements throughout.

DETAILED DESCRIPTION

Figures 1, 3, 4:
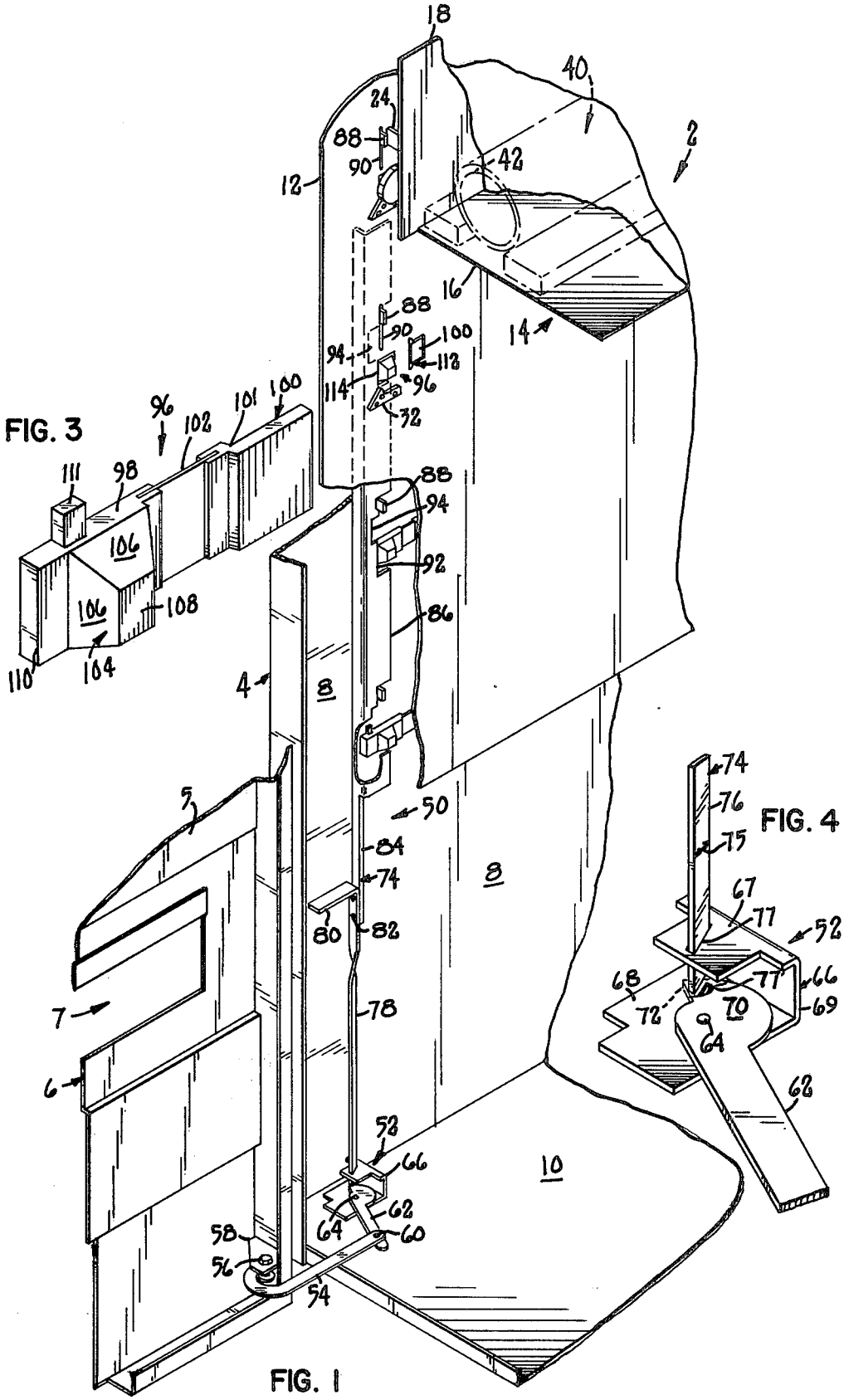
FIG. 1 is a partial perspective view of an improved vending machine and the door and shelf interlock system of this invention.
FIG. 3 is a perspective view illustrating the locking member of the door and shelf interlock system of this invention.
FIG. 4 is a perspective view illustrating the coaction between the locking bar of the door and shelf interlock system of this invention and the pivot structure of the door of the vending machine shown in FIG. 1.

Referring first to FIG. 1, an improved automatic vending machine utilizing the door and shelf interlock system of this invention is generally indicated as 2. Vending machine 2 comprises a substantially rectangular box-like cabinet or housing 4. Housing 4 includes two opposed side walls rigidly joined together by a rear wall, a bottom wall and a top wall. One side wall 8 and the bottom wall 10 are illustrated in FIG. 1. The front of housing 4 is open and is selectively closed by a pivotable door 6 hinged at one side to housing 4 in a generally conventional manner. Door 6 has a transparent panel 5 for viewing the food products contained inside housing 4 and a discharge bin 7 into which food products fall after being dispensed for manual removal by the purchaser.

Housing 4 has a frame provided therein comprising two opposed partitions 12 contained in housing 4 generally adjacent the opposed side walls 8. Only one partition 12 is shown in FIG. 1 extending vertically upwardly and spaced inwardly a short distance from side wall 8. Another identical partition 12 is generally provided adjacent the other side wall of housing 4. Together, the partitions 12 provide a substantially rigid frame for slidably mounting a plurality of vertically spaced dispensing shelves or trays 14.

Figure 2:
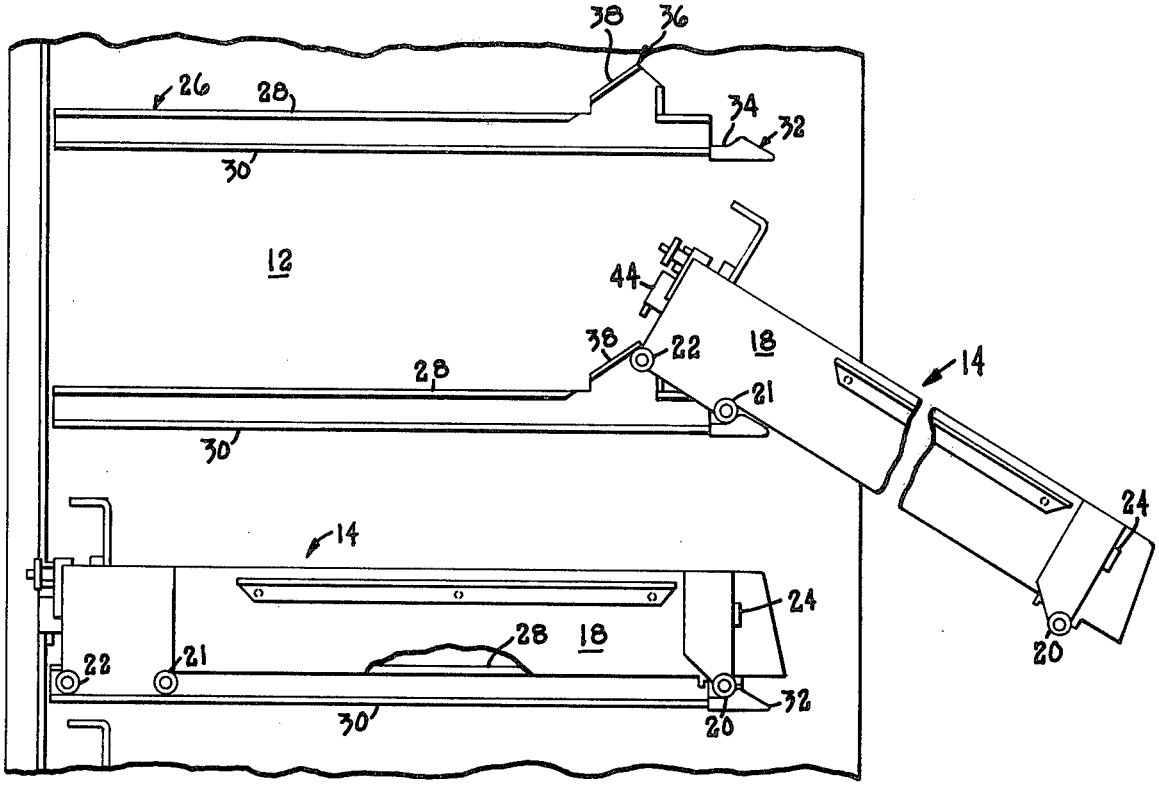
FIG. 2 is a side elevational view of the improved vending machine of FIG. 1 illustrating a dispensing shelf and the structure for movably mounting the shelf in the housing of the vending machine.

Each dispensing shelf 14 comprises a base plate 16, two opposed side walls 18, and a rear wall (not shown) all of which are integrally connected together. Referring to FIG. 2, each side wall 18 rotatably carries a front support roller 20 and first and second rear support rollers 21 and 22. One side wall 18 of each shelf 14 further has a laterally extending ear or stop 24. Stop 24 is located on the same side wall 18 of each shelf 14 (e.g., the left side wall 18 in FIG. 1 when facing housing 4) and forms a portion of the door and shelf interlock system of this invention as described hereafter.

Each of the shelves 14 is slidable between a retracted dispensing position, shown by the lower shelf 14 in FIG. 2, and an extended loading position in which the shelf is at least partially pulled out of housing 4, as shown by the upper shelf 14 in FIG. 2. For this purpose, each of the partitions 12 has a plurality of vertically spaced longitudinally extending tracks 26. Each track 26 comprises a U-shaped channel having top and bottom support surfaces 28 and 30 between which the support rollers 20–22 are received. Two opposed tracks 26 are respectively provided on the opposed partitions 12 at the same vertical level to rollably support each of the shelves 14. A front stop member 32 having a wheel receiving recess 34 is provided at the front end of each track 26 (i.e., the end adjacent door 6). Recesses 34 receive the front support rollers 20 to normally hold the shelf 14 locked in its dispensing position inside housing 4 as shown by the lower shelf 14.

To ease the task of loading the shelves 14 with food products to be dispensed, shelves 14 may be easily rolled to their loading position outside of housing 4 simply by pulling the shelves 14 forwardly on tracks 26. In this regard, each shelf has some play in tracks 26 to allow the shelf 14 to be tilted to remove front support roller 20 from front stop 32. A support member 36 has an upwardly slanted track portion 38 which forms a continuation of top support surface 28. When each shelf 14 is pulled all the way out of housing 4, the second rear support wheel 22 is engaged by the slanted track portion 38 with the first rear support wheel 21 simultaneously held in the front stop 32. This allows shelf 14 to be tilted downwardly relative to housing 4 as shown in FIG. 2 for further easing the task of loading the shelf. However, support member 36 may be deleted from the tracks 26 if so desired. In this case, shelves 14 could still be rolled outwardly to a forward loading position although they could not be tilted downwardly. In addition, support members 36 could be selectively used with some of the shelves 14 and not with others so that only selected ones of the shelves 14 could be tilted.

It is preferred that vending machine 2 be of the type as shown in U.S. Pat. No. 4,061,245, issued to Joseph A. Lotspeich and assigned to the assignee of this invention. Each shelf 14 will have a plurality of dispensing units 40 each comprising an elongated helical coil 42. Helical coil 42 has a plurality of convolutions between which a plurality of food products to be vended are received. Each coil 42 on shelf 14 is connected to a selectively operable electric motor 44. Periodic rotation of coil 42 will dispense the food product contained in the foremost convolution of the coil over the front edge of shelf 14 and will accordingly advance all of the other food products towards the front edge of the shelf. The food product as it is vended falls over the edge of the shelf downwardly into discharge bin 7 on door 6 where the purchaser may manually remove the food product.

Although this invention will be illustrated for use with a helical coil type of vending machine, this invention, which relates to a door and shelf interlock system, is not limited for use with a helical coil vending machine. The door and shelf interlock system of this invention can be used with any type of automatic vending machine or other equipment having a plurality of slidable shelves contained in a housing which is closed by a pivotable door, the shelves being slidable out of the housing primarily for the purpose of loading them with products to be dispensed. These products are normally food products but may be any other type of vendable product. The specific type of dispensing means used on shelves 14 to dispense the products, whether it is a helical coil or some other mechanism, is not critical to this invention.

This invention relates to a door and shelf interlock system generally indicated as 50 in FIG. 1. Interlock system 50 serves two major purposes. First, it prevents any of the shelves 14 from being pulled outwardly in their tracks 26 until the door 6 of vending machine 2 is fully open. Secondly, it prevents the door 6 from being closed if any of the shelves 14 have been pulled outwardly from housing 4 and have not been replaced in their fully retracted dispensing position.

Referring now to FIGS. 1 and 4, door 6 is pivotably attached by top and bottom pivot structures to one side of housing 4. Top pivot structure is of any generally conventional nature (e.g., a simple pivot pin or the like) and is not illustrated in the drawings. However, bottom pivot structure 52 forms part of the interlock system 50 and is illustrated specifically in FIGS. 1 and 4. Bottom pivot structure 52 comprises a first substantially horizontal pivot rod 54. Pivot rod 54 is connected at one end by a pin 56 to an ear 58 fixed on the inside of door 6. The other end of pivot rod 54 is connected by a pin 60 to a second substantially horizontal pivot rod 62. Pivot rod 62 is in turn rotatably connected by a pin 64 to a U-shaped bracket generally indicated as 66. Bracket 66 has top and bottom support flanges 67 and 68 spaced apart by a web 69. In addition, bracket 66 is integrally mounted on bottom wall 10 of housing 4 just inside door 6. Pivot rod 62 has an arcuate support surface 70 located adjacent the pin 64. Support surface 70 defines, in effect, a cam and terminates in a stop or shoulder 72 that extends radially relative to pin 64.

Interlock system 50 further comprises a locking bar 74 which extends vertically upwardly in housing 4 between one side wall 8 and one of the partitions 12. Locking bar 74 is located on the same side of housing 4 as that in which the stops 24 on the shelves 14 are located such that locking bar 74 is proximally located relative to stops 24. The bottom end 76 of locking bar 74 extends down through a slot 77 in the top support flange 67 of bracket 66. A slot 77', identical to and aligned with slot 77, is located in bottom support flange 68. Slot 77' is adapted to receive bottom end 76 of locking bar 74 after door 6 is fully open and support surface 70 has cleared slot 77'. Bottom end 76 is thus guided and supported by bracket 66 and normally rests or bears on the top of support surface 70 of pivot rod 62 when door 6 is not fully open. Moreover, the length 75 of the bottom end 76 of locking bar 74 is substantially equal to the length of shoulder 72.

The bottom end 76 of locking bar 74 comprises part of a twisted lower portion 78 of the bar 74. The twist is provided in the lower portion 78 such that the bottom end 76 is angularly oriented relative to the locking bar 74 to enable it to pass through the slot 77 which is angularly oriented in the top support flange 67. The lower portion 78 of the locking bar 74 is provided with a forwardly projecting handle 80 which an operator can use to manually move the locking bar 74 upwardly. The lower portion 78 of the locking bar 74 is integrally fixed by rivets 82 or similar connecting members to an L-shaped upper portion 84 of locking bar 72. This arrangement allows the upper and lower portions of the locking bar 74 to be manufactured separately to allow the necessary twist to be more easily put into the lower portion 78. This decreases the manufacturing costs of locking bar 74. However, the lower and upper portions 78 and 84 could be made in a single piece if so desired.

The L-shaped upper portion 84 of locking bar 74 has one side 86 thereof which is located generally parallel to partition 12. Locking bar 74 further includes means for normally locking each of the shelves 14 in their retracted dispensing position inside housing 4. This locking means comprises a plurality of vertically spaced latches 88 integrally fixed to the side 86 of locking bar 74. Each latch 88 projects inwardly from the locking bar 74 through one of a series of vertically spaced slots 90 located in partition 12. In addition, the side 86 of locking bar 74 includes a repeating series of solid portions or lands 92. A locking notch or recess 94 is located in the side 86 immediately above each of the lands 92. The purpose of the lands 92 and locking recesses 94 will be explained in more detail hereafter.

A plurality of vertically spaced locking members 96 are fixedly carried on partition 12. One locking member 96 is located adjacent each of the shelves 14. Referring to FIG. 3, each locking member 96 comprises a plastic body 98 resiliently coupled to a plastic mounting member 100 by a biasing means 102. Biasing means 102 preferably comprises a piece of spring steel whose opposite ends are respectively fixedly received in mounting member 100 and body 98. If desired, spring steel biasing means 102 could be completely encased in a solid locking member 96 in which the body 98 and the mounting member 100 are integrally joined. However, the body 98, mounting member 100 and biasing means 102 could be separate pieces attached together without encasement of biasing means 102 as shown in FIG. 3.

Body 98 includes an integral inwardly projecting locking tab 104 on one side thereof. Locking tab 104 is in the form of a truncated pyramid having a plurality of sides 106 terminating in an inner vertical surface 108. Body 98 further has a front end 110 which is located immediately in front of the locking tab 104. The front end 110 of the locking member defines a locking surface which is suitable for engagement in one of the locking recesses 94 for a purpose to be explained hereafter. The body 98 further includes an upwardly projecting tab 111.

Each of the locking members 96 is mounted in one of a series of vertically spaced struck-out portions 112 located on the inside surface of partition 12. Each struck-out portion 112 forms a pocket which receives the mounting member 100 of locking member 96. The mounting member 100 is trapped in the pocket formed by the struck-out portion 112 by means of the U-shaped tracks 26 which extend across the struck-out portion 112. The mounting member 100 has a slanted portion 101 therein which extends through a slot 113 in the partition 12 adjacent the struck-out portion 112. Thus, the body 98 of the locking member 96 is maintained outside the partition 12 and is slightly offset from mounting member 100. However, the locking tab 104 of each locking member 96 protrudes through one of a plurality of vertically spaced, rectangular openings 114 in the partition 12. Each rectangular opening 114 is located generally above each of the front stop members 32 at the front of the tracks 26. By virtue of the mounting arrangement of the locking member 96 and the biasing action exerted on body 98 by biasing means 102, body 98 is normally biased inwardly such that the locking tab 104 extends through the opening 114. The vertical tab 111 bears against the outside surface of the partition 12 to serve as a stop or limit for the projection of locking member 96 through the partition 12.

With regard to the operation of the door and shelf interlock system 50, when the vending machine door 6 is closed with all the shelves 14 received in their retracted dispensing positions, locking bar 74 will have its lower end 76 supported on top of the support surface 70 of pivot rod 62. In this first upper position for locking bar 74, all of the latches 88 will be aligned with and placed in front of the corresponding stops 24 on the shelves 14. This locks shelves 14 in their retracted dispensing positions.

When the vending machine serviceman or operator wishes to load shelves 14 with a plurality of food products to be vended (e.g., by placing the products between the convolutions of the helical coils 42 on the shelves), the operator unlocks door 6 and swings it to a fully open position. During the intitial opening of door 6, the bottom end 76 of locking bar 74 is still supported by support surface 70. However, when door 6 reaches its fully open position, but not before, the bottom end 76 of locking bar 72 drops off support surface 70. Locking bar 74 then falls downwardly a short distance to a second lower position in which the lower end 76 of the locking bar abuts against shoulder 72 on pivot rod 62 and is received in slot 77' in bottom support flange 68. In this second lower position of locking bar 74, all the latches 88 have been moved downwardly from their interfering relationship with stops 24 to a position in which all of the latches 88 clear the stops 24. Thus, locking bar 74 by being kept in its upper position until door 6 is fully open prevents any of the shelves 14 from being pulled outwardly by virtue of the engagement of the latches 88 with stops 24. However, when door 6 becomes fully open, all of the shelves 14 can be selectively pulled out to load them with food products.

Figure 5:
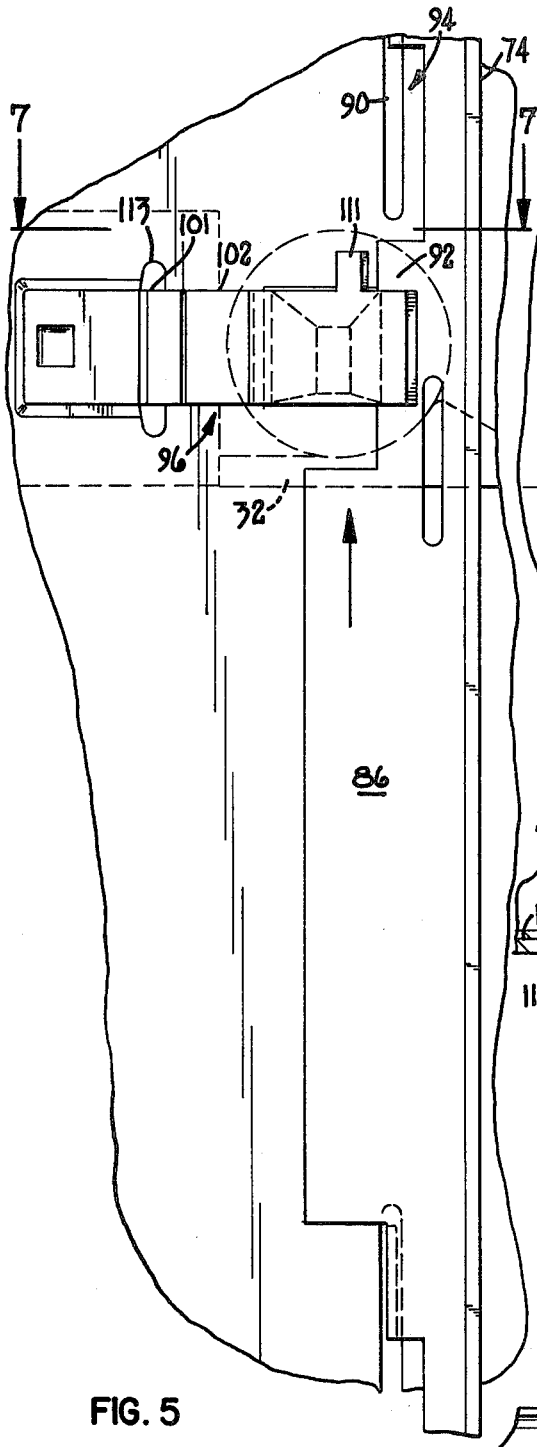
FIG. 5 is a partial side elevational view of the door and shelf interlock system of this invention, illustrating the locking bar in a first upper position in which it locks all of the dispensing shelves in the housing of the vending machine.
Figure 6:
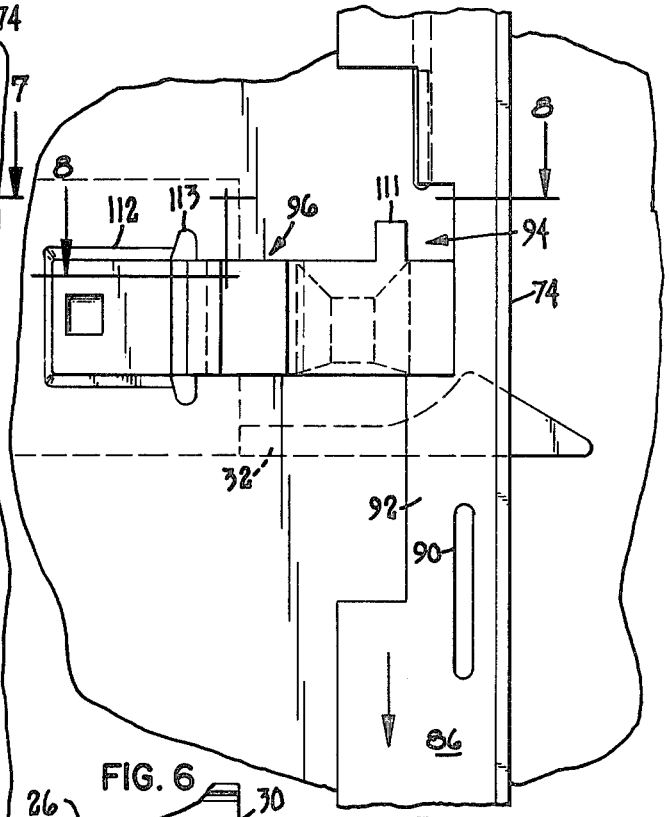
FIG. 6 is a partial side elevational view of the door and shelf interlock system of this invention, illustrating the locking bar in a second lower position in which it unlocks all of the shelves to allow the shelves to be pulled outwardly from the housing of the vending machine.
Figure 8:
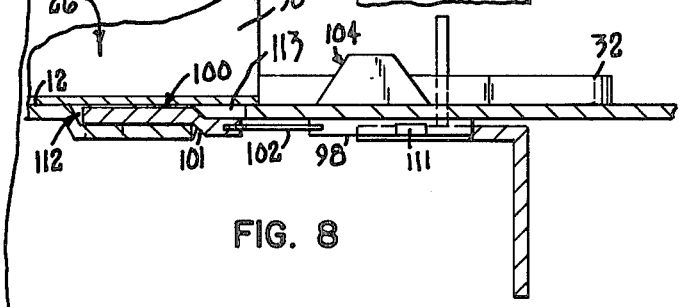
FIG. 8 is a cross-sectional view along lines 8—8 in FIG. 6 of the locking member of FIG. 7, illustrating the locking member moved inwardly to a second position in engagement with the locking bar to prevent the door of the vending machine from being closed.
Figure 7:
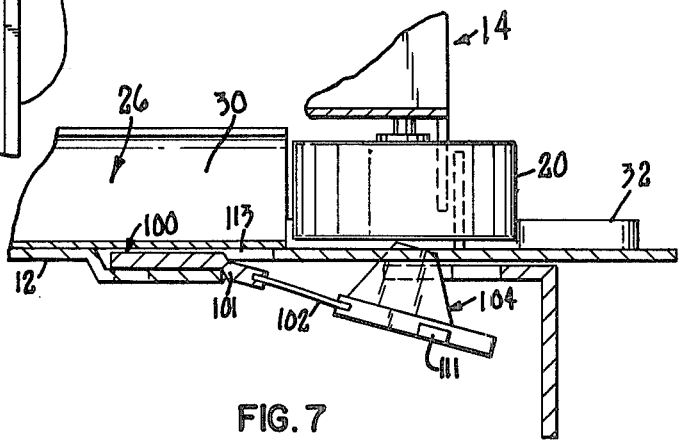
FIG. 7 is a cross-sectional view along lines 7—7 in FIG. 5 of one of the locking members of the door and shelf interlock system of this invention illustrating the locking member biased outwardly in a first position out of engagement with the locking bar.

When latch bar 74 drops to its lower position, each of the latch recesses 94 become horizontally aligned with the locking members 96. In other words, the front end 110 of each locking member 96, which normally faces the corresponding land 92 when locking bar 74 is in its upper position as shown in FIG. 5, now is aligned with and faces the locking recess 94 as seen in FIG. 6. However, when each shelf is in its retracted dispensing position, one front support roller 20 engages the locking tab 104 on each of the locking members 96 and cams the locking member 96 outwardly relative to partition 12, as seen in FIG. 7. In this outward position of the locking member 96, the locking surface defined by front end 110 of the locking members is transversely spaced out of engagement with the locking recess 94. However, as soon as the shelf 14 is pulled out from its retracted dispensing position, front roller 20 leaves the recess 34 of front stop 32 and thus is no longer present to oppose the locking tab 104 on the locking member 96. Because of the resilient biasing effect of biasing means 102, locking tab 104 springs through the corresponding opening 114 located in the partition 12. As shown in FIG. 8, in this second position of locking member 96, the front end locking surface 110 engages the locking recess 94 in the locking bar 74. Locking member 96 will retain the position shown in FIG. 8 as long as shelf 14 is pulled outwardly from housing 4 and the front roller 20 is not received in the front stop 32.

Thus, when any of the shelves 14 are pulled out from their retracted dispensing positions, the front end locking surface 110 on the locking member 96 associated with the shelf will engage the corresponding locking recess 94 in the locking bar 74. If the vending machine operator attempts to close door 6, he is prevented from doing so because the lower end 76 of the locking bar 74 is still received in slot 77' and is engaged with the shoulder 72 of the pivot rod 62. This prevents pivot rod 62 from rotating about the pin 64. Door 6 cannot be closed until the lower end 76 of the locking bar 74 is lifted up out of engagement with the shoulder and is re-engaged on top of support surface 70. However, locking bar 74 cannot be moved upwardly because of the engagement of the front end locking surface 110 in the locking recess 94. Upward movement of the locking bar 74 is allowed only when all shelves 14 are in their fully retracted positions causing all the front rollers 20 to engage the locking members 96 to bias the locking members 96 to their outer position shown in FIG. 7.

When each of the shelves 14 is fully pulled out of the housing 4, each of the locking members 96 would be moved to its FIG. 7 position since tab 104 would be engaged by the rear support roller 21. However, the danger of the operator closing the door 6 against a shelf 14 which is fully pulled out is negligible. The greatest risk is that the operator will close the door 6 against a shelf 14 which is less than fully pulled out, especially one which extends only a short distance outwardly from its retracted dispensing position. In this event, the door and shelf interlock system 50 of this invention prevents closing of the door 6 as described above.

Door and shelf interlock system 50 provides a simple and convenient system for performing a number of advantageous fractions. First, it prevents any of the shelves 14 from being pulled out until door 6 is fully open. Secondly, it also prevents door 6 from being closed until all the shelves 14 are placed in a fully retracted dispensing position. This decreases the risk of damage to the machine by a vending machine serviceman or operator who might otherwise inadvertently pull shelves out and bang them against a door which is not fully open, or, conversely, might attempt to close door 6 against a shelf 14 which is still protruding from the housing 4 of vending machine 2. Thus, door and shelf interlock system 50 prevents accidents which otherwise would damage vending machine 2. This decreases the number of repair calls needed to fix machine 2. Consequently, less expense is incurred in operating vending machine 2.

Door and shelf interlock system 50 provides the above-noted advantages and is less costly and more positive in its operation than prior art systems. In particular, door and shelf interlock system 50 is operative in preventing door 6 from being closed against an extended shelf by the absence of front roller 20 from its normal position in tracks 26. This means that door and shelf interlock system 50 is fool-proof in its operation and does not require the presence of an element on the shelf for its operation, which element may or not be present depending on the particular type of vending machine being used. Since almost all vending machines having slidable shelves are provided with a system of support rollers similar to those described herein, door and shelf interlock system 50 can be easily adapted to most existing vending machines. In addition, the element on shelf 14 which cams locking member 96 out of engagement with the locking bar 74 need not necessarily be a roller. A suitable protruding lug could be provided on the shelf 14 to cam locking member 96 outwardly in the retracted position of shelf 14.

Various modifications will be apparent to those skilled in the art. For example, although the form of locking member 96 illustrated herein is preferred, various other types of locking members could also be used. For example, a locking member might be used which is pivotted to partition 12 of vending machine 2 and which has a compression spring placed between its rear surface and the side wall 8 of the machine 2 to force the locking member inwardly through opening 114. Alternatively, a locking member could be formed integrally from a suitably resilient material and be anchored to partition 12 such that the locking member normally springs through opening 114. Moreover, support surface 70 could take any form as long as it allows the locking bar 74 to drop downwardly only when door 6 is fully open. Thus, the scope of this invention is to be limited only by the appended claims.

What is claimed is:

1. An improved vending machine of the type having a housing; a door pivotably carried on the housing for movement between substantially open and closed positions; a plurality of shelves movably mounted in the housing for movement between a dispensing position located inside the housing and a loading position located at least partially outside the housing; dispensing means carried in the housing for dispensing products contained on each of the shelves; and wherein the improvement relates to a door and shelf interlock system, which comprises:

(a) an elongated locking bar mounted in the housing for movement between first and second positions, the locking bar having latch means which operatively engages each of the shelves when the locking bar is in its first position to prevent the shelves from being pulled outwardly from their dispensing positions, the latch means in the second position of the locking bar disengaging the shelves to allow the shelves to be pulled outwardly relative to the housing, the locking bar being operatively connected to the door such that the locking bar moves from its first to its second position only when the door is in its substantially open position, and the locking bar in its second position further preventing the door from being closed from its substantially open position; and (b) a plurality of locking members which are respectively individually cooperable with one of the shelves, each locking member being engaged by a shelf when the shelf is in its dispensing position such that the locking member is spaced from the locking bar to allow free vertical movement thereof to allow the door to be opened or closed, each of the locking members being movable into engagement with the locking bar to prevent the locking bar from being moved vertically when the corresponding shelf is pulled outwardly from its dispensing position, thereby preventing the door from being closed on any of the shelves in their loading position.

2. An improved vending machine as recited in claim 1, in which the latch means on the locking bar comprises a series of vertically spaced latches, each one of the latches being aligned in an interfering relationship with a stop on the corresponding shelf when the locking bar is in its first position.

3. An improved vending machine as recited in claim 1, in which each of the locking members includes a locking surface, the locking bar further having a locking recess horizontally aligned with the locking surface when the locking bar is in its second position, the locking surface engaging the corresponding locking recess to prevent upward movement of the locking bar when the corresponding shelf is pulled outwardly from its dispensing position.

4. An improved vending machine as recited in claim 1, in which the door is pivotably connected to the housing by a pivot structure which has at least one pivot member, the pivot member defining a cam surface on which a lower end of the locking bar engagingly rests, the cam surface of the pivot member being configured to allow the locking bar to drop downwardly under the force of gravity from its first to its second position when the door reaches its substantially open position and not before.

5. An improved vending machine as recited in claim 4, wherein the cam surface terminates in a shoulder, the lower end of the locking bar engaging the shoulder when the locking bar is in its second position, the engagement of the locking bar with the shoulder preventing the pivot member from being pivotted to prevent the door from being closed.

6. An improved vending machine as recited in claim 5, in which the locking bar has a handle member for raising the locking bar upwardly from its second to its first position to reset the lower end of the locking bar on top of the cam surface and break the engagement with the shoulder thereof, thereby allowing the door to be closed.

7. An improved vending machine as recited in claim 1, further comprising a partition in the housing which defines a portion of a frame that slidably mounts each of the shelves, wherein each of the locking members are fixed at one end to the partition and has a locking tab at the other end which protrudes inwardly relative to the shelf, each shelf having at least a front roller which biases the locking member outwardly relative to the partition such that the locking surface on the locking member is out of alignment with the locking bar, the locking member further including means for biasing the locking member inwardly relative to the partition whereby the absence of the roller on the shelf allows the locking member to move inwardly until the locking surface is in engagement with the locking recess on the locking bar to thereby latch the locking bar in its second position.

8. An improved vending machine as recited in claim 7, in which the locking surface is defined by the end of the locking member generally adjacent the locking tab.

9. An improved vending machine as recited in claim 7, in which the biasing means comprises forming the locking member from a resilient material.

10. An improved vending machine as recited in claim 7, in which the biasing means comprises a piece of spring steel which forms a portion of the locking member.

11. An improved vending machine for dispensing products of the type having a housing; a door pivotably connected to the housing by a pivot structure; a plurality of shelves slidably mounted in the housing for movement between a retracted position inside the housing and an extended position at least partially outside the housing, wherein each of the shelves may be loaded with products when the door is open and the shelves are in their extended positions; means for dispensing the products contained on each of the shelves; and wherein the improvement which comprises means for locking the shelves in their retracted position inside the housing until the door is fully opened, the locking means comprising:

(a) an elongated locking bar vertically movable in the housing between first and second positions, the locking bar having a plurality of latches which are respectively aligned with a stop on each one of the shelves when the locking bar is in its first position to hold all of the shelves in their retracted positions and which clear all of the stops in the second position of the locking bar to allow the shelves to be selectively pulled outwardly; and (b) a cam formed on the pivot structure of the door, the cam defining an upwardly facing support surface on which the lower end of the locking bar rests, the cam being configured to allow the locking bar to fall off the support surface to drop downwardly from its first to its second position only when the door reaches a fully open position, thereby preventing any of the shelves from being pulled outwardly until the door is fully opened.

12. An improved vending machine as recited in claim 11, further including means for locking the locking bar in its second position to latch the pivot structure of the door in an open position thereby preventing the door from being closed, the means for locking the locking bar being operative whenever any of the shelves are not in a fully retracted position inside the housing.

13. An improved vending machine of the type having a housing; a door pivotably carried on the housing for movement between substantially open and closed positions; a plurality of shelves movably mounted in the housing for movement between a dispensing position located inside the housing and a loading position located at least partially outside the housing; dispensing means carried in the housing for dispensing products contained on each of the shelves; and wherein the improvement relates to a door and shelf interlock system, which comprises:

(a) means for locking each of the shelves in their dispensing position inside the housing until the door is placed in its substantially open position, the shelf locking means comprising a vertically movable locking bar operatively connected to the door; and (b) means for locking the door in its substantially open position if any of the shelves are placed in their loading position, the door locking means comprising a plurality of locking members which are respectively individually cooperable with one of the shelves, each locking member being movable in the housing between a first position in which the locking member allows vertical movement of the locking bar and a second position in which the locking member prevents vertical movement of the locking bar; means for biasing each locking member from its first to its second position; wherein each locking member is normally placed into its first position by engagement with the shelf when the shelf is in its dispensing position to allow the door to be opened and closed, and wherein each locking member is cleared by its corresponding shelf whenever the corresponding shelf is pulled outwardly from its dispensing position to allow the biasing means to move the locking member into its second position to lock the door in its open position.

* * * * *

UNITED STATES PATENT AND TRADEMARK OFFICE

CERTIFICATE OF CORRECTION

PATENT NO. : 4,196,951

DATED : April 8, 1980

INVENTOR(S) : Joseph A. Lotspeich

It is certified that error appears in the above-identified patent and that said Letters Patent are hereby corrected as shown below:

In column 8, line 58, for "fractions" read --functions--.

Signed and Sealed this

*Fifteenth* Day of *July 1980*

[SEAL]

*Attest:*

SIDNEY A. DIAMOND

*Attesting Officer*

*Commissioner of Patents and Trademarks*